US005505537A

United States Patent [19]

Previero

[11] Patent Number: 5,505,537

[45] Date of Patent: Apr. 9, 1996

[54] CONICAL-BOTTOM SILO, PARTICULARLY SUITABLE FOR SMALL-SIZED PLASTIC MATERIAL AND RUBBER WITH HIGH ELASTICITY PROPERTIES, HAVING A DISCONTINUOUS SCREW STIRRER

[75] Inventor: Flavio Previero, Lipomo, Italy

[73] Assignee: Sorema s.r.l., Erba, Italy

[21] Appl. No.: 307,755

[22] Filed: Sep. 26, 1994

[30] Foreign Application Priority Data

Mar. 27, 1992 [IT] Italy ..... MI92A0736

[51] Int. Cl.[6] ..... B01F 7/24; B01F 15/02; B01F 15/06

[52] U.S. Cl. ..... 366/97; 366/147; 366/186; 366/196; 366/314; 366/322; 366/323; 34/182

[58] Field of Search ..... 366/89, 90, 98, 366/97, 102–104, 147, 186, 194–196, 314, 322, 323, 318; 34/171, 173, 181, 182

[56] References Cited

U.S. PATENT DOCUMENTS

| | | | |
|---|---|---|---|
| 424,808 | 4/1890 | McAllister | 34/182 |
| 1,879,928 | 9/1932 | Eakins | 366/251 |
| 3,339,759 | 9/1967 | Wellons | 366/186 X |
| 3,797,550 | 3/1974 | Latinen | 366/323 X |
| 4,171,165 | 10/1979 | Card | 366/186 |
| 4,185,925 | 1/1980 | Gazzoni . | |

FOREIGN PATENT DOCUMENTS

| | | | |
|---|---|---|---|
| 1572753 | 6/1969 | France . | |
| 309629 | 11/1917 | Germany | 366/318 |
| 1941163 | 2/1971 | Germany . | |
| 1535612 | 1/1990 | U.S.S.R. | 366/323 |

OTHER PUBLICATIONS

Patent Abstract of Japan, vol. 013, No. 237 (M833) 5 Jun. 1989 and JP, A, 10 49 605 (Matsui Seisakusho KK) see abstract; figure.

Modern Plastics International, vol. 12 No. 12 Dec. 1982, Lausanne, CH p. 65 Werner & Pfleiderer Maschinenfabrik "Unit drys materials while on conveyors."

*Primary Examiner*—Charles E. Cooley

*Attorney, Agent, or Firm*—Cushman Darby & Cushman

[57] ABSTRACT

A conical-bottom silo, particularly suitable for small-sized pieces of plastic material with properties of high elasticity, includes a conical screw stirrer inserted axially in the conical bottom of the silo. The conical screw of the stirrer is discontinuous and divided into several sections. The silo has a structure for discharging the material arranged below an outlet port positioned laterally in relation to the stirrer and including two co-operating cylindrical screws. The stirrer can be provided with apertured grill outlets for heated, forced air.

4 Claims, 3 Drawing Sheets

CONICAL-BOTTOM SILO, PARTICULARLY SUITABLE FOR SMALL-SIZED PLASTIC MATERIAL AND RUBBER WITH HIGH ELASTICITY PROPERTIES, HAVING A DISCONTINUOUS SCREW STIRRER

BACKGROUND OF THE INVENTION

The present invention relates to a conical-bottom silo which is particularly, albeit not solely, suitable for small-sized pieces of plastic material and rubber with characteristics of high elasticity, as in the case of plastics of the "stretch" type (LLPE, linear, low, polyethylene).

Silos for small-sized pieces of plastic material are already known, such as the silo described in the U.S. Pat. No. 4,185,925. This patent relates to a conical-bottom silo with a conical screw stirrer inserted axially in the conical bottom of the silo and a cylindrical screw delivery and outlet part situated at an outlet port arranged laterally in relation to the stirrer at the lower end of the conical bottom of the silo.

A silo of this type functions perfectly for the various kinds of small-sized pieces of plastic material except in the case wherein particularly elastic plastics and rubber are being dealt with. With a material having these properties, areas of compression can in fact form in the conical bottom of the silo due to the action performed by the stirrer. Blocks of materials, which prevent the conical screw and the relative motor from moving, are then created in these areas. As a result thereof, there is discontinuity of operations and feeding (metering) of the material during delivery and strong mechanical stress of the screw with subsequent damage thereto and possible breakage of the motor.

SUMMARY OF THE INVENTION

The main object of the present invention is therefore to provide a conical-bottom silo with a conical screw stirrer, particularly suitable for small-sized pieces of plastic materials and rubber with high elasticity.

In accordance with the invention, the main object is achieved by means of a conical-bottom silo with a conical screw stirrer inserted axially in the conical bottom of the silo, characterised in that the conical screw of the stirrer is discontinuous and divided into several sections.

The use of a thus discontinous conical screw allows the action of compression on the material, which occurs during the movement of the stirrer itself, to be released: the divisions of the screw, enabling the material to expand, in fact prevent the formation of compressed blocks of material inside the lower conical body of the silo.

BRIEF DESCRIPTION OF THE DRAWINGS

The features of the present invention will be made clearer by the following detailed description of its possible embodiments, shown by way of a non-limitative example in the accompanying drawings, in which.

DETAILED DESCRIPTION OF THE DRAWINGS

Figure 1:
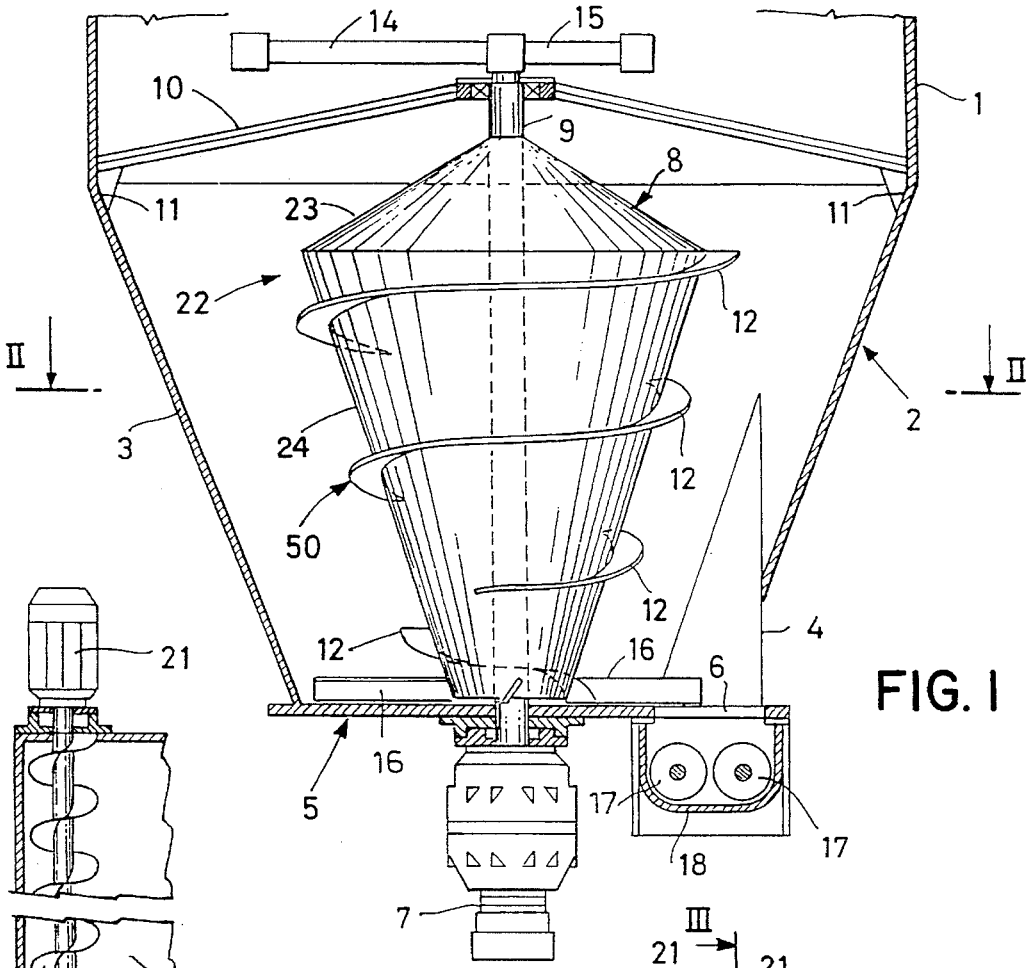
FIG. 1 shows in an axial section the lower part of a silo according to the invention, with a discontinuous conical screw mounted on leaf springs.

The silo illustrated in FIGS. 1 and 2 essentially comprises a cylindrical wall 1 which extends axially for almost all the vertical extension of the silo, with the exception of a bottom part 2 provided with a conical wall 3 ending below with a squared portion 4.

A plate 5 provided with a rectangular aperture 6 displaced laterally towards the squared wall 4 closes off the conical bottom 2 of the silo and supports in a central position, that is to say along the axis of the conical wall 3 and of the cylindrical wall 1 above, a motor 7 for rotating a discontinuous conical screw stirrer 8 inserted in the conical base 2.

The stirrer comprises a central shaft 9 supported by the motor 7 and maintained in a perfect axial position by three arms 10 (only two are shown in FIG. 1) arranged at 120° one in respect of the other and attached by means of small plates 11 to the area where the walls 1 and 3 join. Around the shaft 9 extends a conical screw 50 which is discontinuous and divided into several sections 12, each of which is attached to the shaft itself by means of elastic leaf spring arms in a number varying according to the extension of the section 12.

Two blades 14 and 15 of different radius are also attached to the top of the shaft 9 to maintain stirring of the material above the arms 10.

At the base of the shaft 9, at the plate 5, there are four blades 16 of equal length directly connected to the shaft itself and arranged at 90° one to the other.

Figure 3:
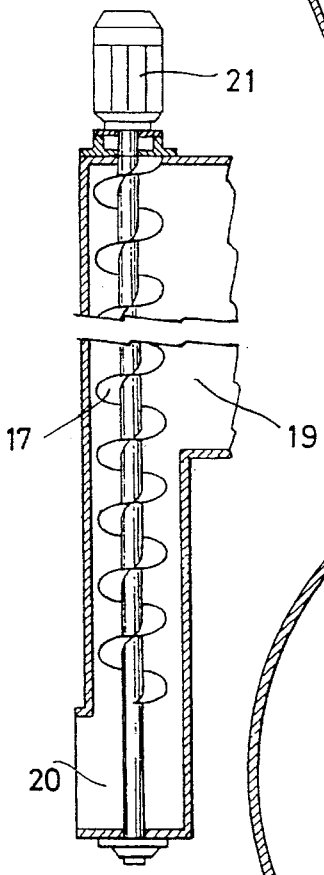
FIG. 3 shows the outlet part of the silo in section along line III—III of FIG. 2.
Figure 2:
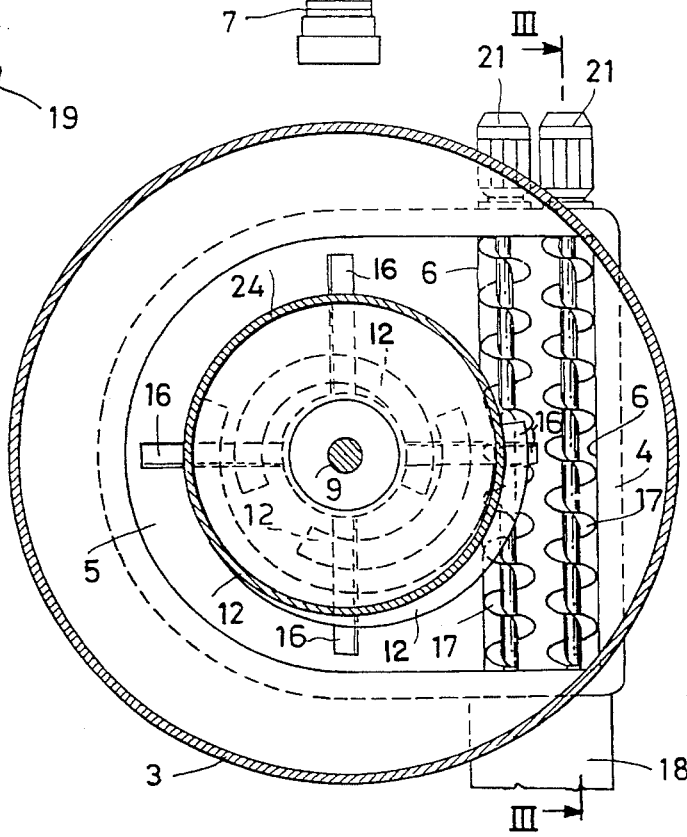
FIG. 2 shows said the lower part of the silo sectioned transversely along line II—II of FIG. 1.

Finally, below the plate 5, at the rectangular aperture 6, a double cylindrical delivery screw 17 is transversely arranged and rotatably supported by a cylindrical casing 18 provided with an inlet mouth 19 and an outlet mouth 20 and which is rotated by a pair of motors 21 (FIGS. 2 and 3).

During operation, the motor 7 rotates, in the direction with reference of FIG. 2, the discontinuous conical screw 8, which causes a slow rising movement of the material which is placed inside the conical development defined by the discontinuous screw 12.

The material itself then falls by gravity along the conical wall 3, producing an output flow at a constant flow rate through the outlet port 6. The constant flow rate is ensured by the non-compressed state of the material in the conical part 2 due to the stirring created by the part 8, and by the support action performed by the arms 10 on the material above the cylindrical part.

In the event of any phenomena of compression in the material at the subsequent section of screw 12, the fact that the screw 50 is not continuous enables subsequent decompression of the material; moreover, when blocks of material form, elastic deformation of the sections of screw 12 also occurs so as to contribute to an immediate decompression of the material itself and prevent permanent deformations of the stirrer 8.

The task of the four blades 16 at the base of the shaft 9 is to scrape the plate 5 to facilitate discharge of the material accumulated on the base of the silo through the outlet port 6.

As far as the output and delivery of the plastic material are concerned, the double horizontal cylindrical screw 17 conveys the material to the centre of the delivery part and transports it towards the outlet mouth 20, avoiding phenomena of friction of the material against the fixed wall 18 and thus guaranteeing an even and continuous discharge of material.

Figure 4:
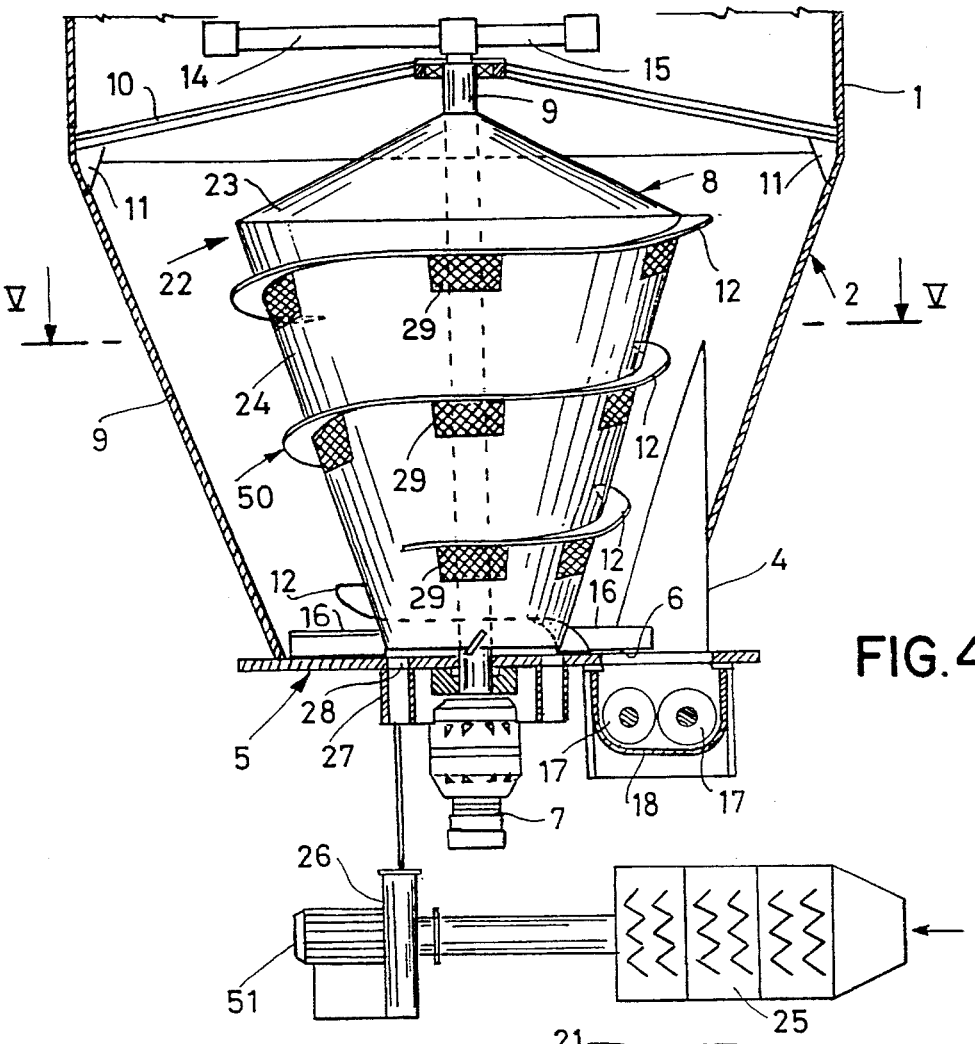
FIG. 4 Show in axial section the lower part of a silo according to the invention, with the discontinuous conical screw mounted on a double truncated cone support.
Figure 5:
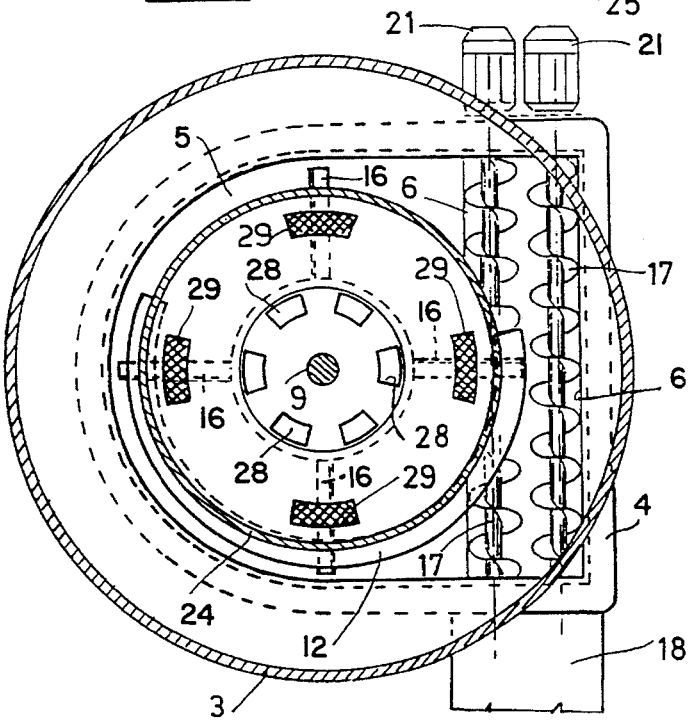
FIG. 5 Shows the lower part of the silo sectioned transversely along line V—V of FIG. 4.

The silo described in FIGS. 4 and 5 differs from that described in FIGS. 1, 2 and 3 only as regards the support of the discontinuous conical screw 50.

The stirrer 22, inserted in the conical bottom 2, also comprises a central shaft 9 supported by the motor 7. However, the central shaft is this time integral with two truncated cones 23 and 24, hollow internally and matching at their largest base. The sections of the discontinuous conical screw 12 are located on the external wall of the lower truncated cone 24.

The blades 16 are inserted, in this case, at the base of the lower truncated cone 24 at the plate 5 (FIGS. 4 and 5).

The two truncated cones 23 and 24 make the structure of the stirrer 22 stronger and facilitate operations for cleaning it.

Figure 6:
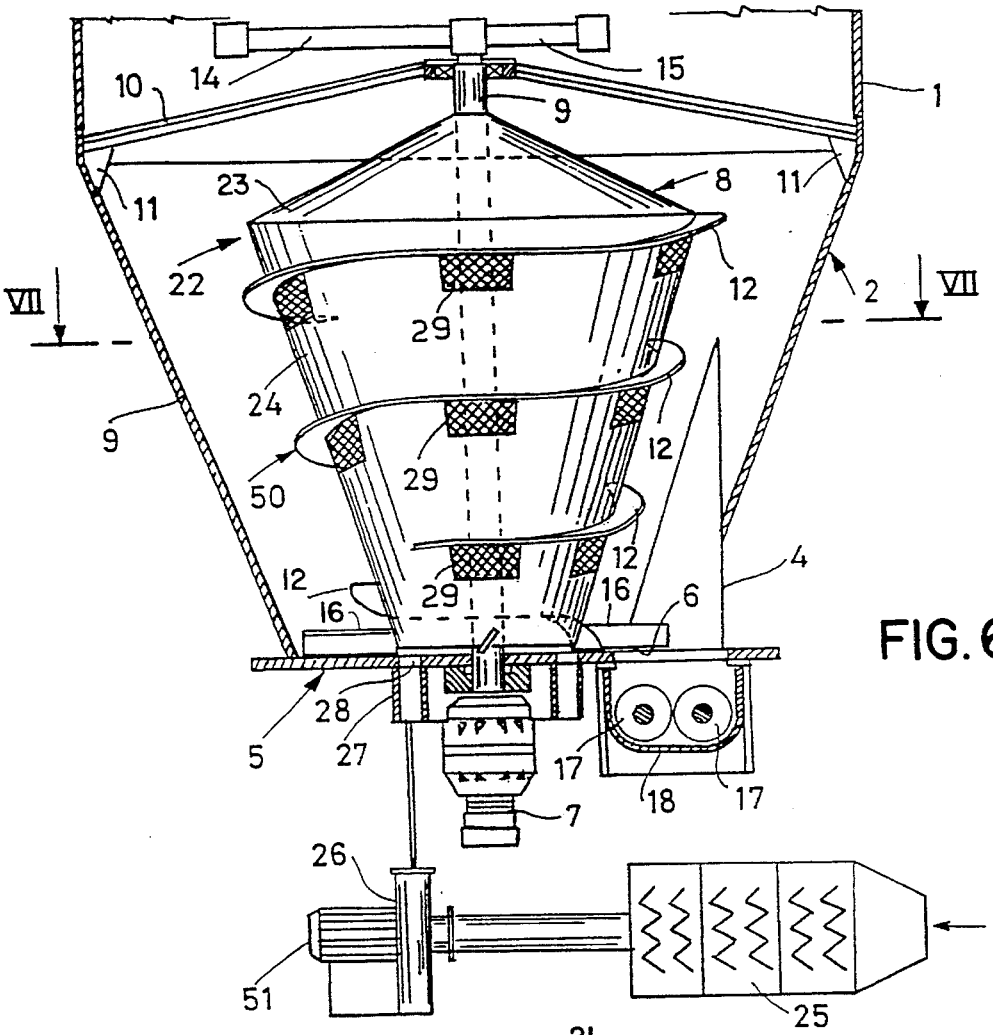
FIG. 6 Shows in axial section the lower part of a silo according to the invention, with the discontinuous conical screw mounted on a double truncated cone support, and with means for the forced supply of air.
Figure 7:
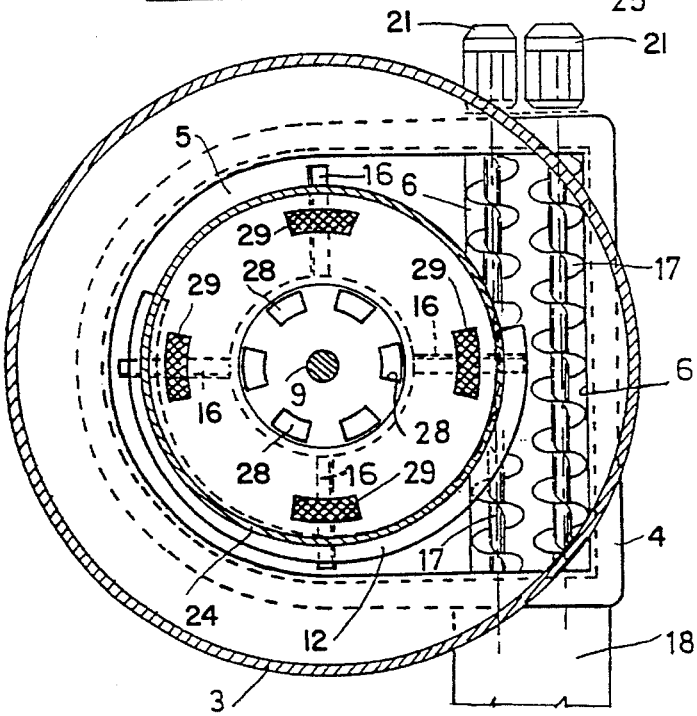
FIG. 7 shows the lower part of the silo sectioned transversely along line VII—VII of FIG. 6.

FIGS. 6 and 7 show a variant of the silo of FIGS. 4 and 5 in which, in addition to the devices described previously, an air filter 25, a fan 26 with a motor 51 and a hollow ring 27, placed axially below the plate 5, are provided. The plate 5 has, in turn, at the hollow ring 27 and the base of the lower truncated cone 24, six apertures 28 and, to conclude, the side wall of the truncated cone 24 is provided with grating-covered rectangular apertures 29 below the screw sections 12.

The air filtered by the filter 25 and compressed by the fan 26 is emitted, through the hollow ring 27 and the apertures 28 of the plate 5, into the internal cavity of the two truncated cones 23 and 24 and from which it is released, through the grating-covered apertures 29, into the cavity of the bottom part 2 of the silo.

The emission of filtered air has a fluidification effect on the material, which facilitates its discharge, and the detachment of the same material from the external wall of the lower truncated cone 24.

In the event of use of hot air, there is also a drying effect on the material such that the silo can be used as a dryer.

I claim:

1. A conical-bottom silo for small-sized plastic material and rubber with high elasticity properties, comprising:

an upright cylindrical housing having a conically curved lower sidewall portion which converges downwards towards a bottom plate which has an outlet port for said silo provided therethrough;

an upright stirrer disposed in said housing so as to be spacedly circumferentially surrounded by said conically curved lower sidewall portion, and supported for rotation about a vertical axis;

said stirrer having an upwardly convergent upper conical portion and a downwardly convergent lower conical portion which axially adjoin and are coaxially centered on said vertical axis for rotation together about said vertical axis;

a stirring vane means externally provided on said lower conical portion so as to spiral abut said stirrer along said axis, said stirring vane means being divided into a plurality of sections serially separated from one another by a succession of gaps.

2. The silo of claim 1, further including:

means defining a plurality of grating-covered apertures in said lower conical portion of said stirrer, adjacent said stirring vane means; and means for forcing air from outside said silo into said stirrer for emergence into said conically curved lower sidewall portion of said housing through said grating-covered apertures.

3. The silo of claim 2, wherein:

said forcing means includes a heater for heating said air.

4. The silo of claim 1, wherein:

said outlet port is laterally offset from said axis and is served by a set of two cooperating parallel delivery screws received in a casing having an inlet communicated with said outlet port, said casing having an outlet extending along a portion of said screws and spaced from said inlet.

* * * * *

UNITED STATES PATENT AND TRADEMARK OFFICE
CERTIFICATE OF CORRECTION

PATENT NO. : 5,505,537

DATED : April 9, 1996

INVENTOR(S) : PREVIERO

It is certified that error appears in the above-identified patent and that said Letters Patent is hereby corrected as shown below:

On the title page:

change item [22] from "Filed: Sep. 26, 1994" to
--PCT Filed: March 24, 1993--;

add item [86], to include:
--PCT No.: PCT/EP93/00713--;
--§ 371 Date: Sep. 26, 1994--;
--§ 102(e) Date: Sep. 26, 1994--; and add item [87], to include:
--PCT Pub. No.: WO93/19842--;
--PCT Pub. Date: Oct. 14, 1993--.

Signed and Sealed this

Second Day of July, 1996

Bruce Lehman

*Attest:*

BRUCE LEHMAN

*Attesting Officer*

*Commissioner of Patents and Trademarks*